US008172109B2

(12) United States Patent
Cadden

(10) Patent No.: US 8,172,109 B2
(45) Date of Patent: May 8, 2012

(54) NOZZLE AND/OR ADAPTOR UNIT ON CARTRIDGE

(75) Inventor: Stephen Cadden, Glasgow (GB)

(73) Assignee: Rawlplug Limited, Glasgow (GB)

( * ) Notice: Subject to any disclaimer, the term of this patent is extended or adjusted under 35 U.S.C. 154(b) by 434 days.

(21) Appl. No.: 12/278,548

(22) PCT Filed: Feb. 7, 2007

(86) PCT No.: PCT/GB2007/000439

§ 371 (c)(1),
(2), (4) Date: Mar. 10, 2009

(87) PCT Pub. No.: WO2007/091071

PCT Pub. Date: Aug. 16, 2007

(65) Prior Publication Data

US 2009/0179045 A1 Jul. 16, 2009

(30) Foreign Application Priority Data

Feb. 7, 2006 (GB) ..... 0602340.2

(51) Int. Cl.
*B65D 35/22* (2006.01)

(52) U.S. Cl. ..... 222/94; 222/326

(58) Field of Classification Search ..... 222/94, 222/95, 105, 326, 99, 566, 568, 145.6, 325–327, 222/145.5, 153.01, 153.02
See application file for complete search history.

(56) References Cited

U.S. PATENT DOCUMENTS

| | | | | | |
|---|---|---|---|---|---|
| 3,861,522 | A | | 1/1975 | Llewellyn et al. | |
| 4,227,612 | A | | 10/1980 | Dillon | |
| 4,269,330 | A | | 5/1981 | Johnson | |
| 4,340,154 | A | | 7/1982 | VanManen | |
| 5,226,562 | A | | 7/1993 | Kirk | |
| 5,332,122 | A | * | 7/1994 | Herold et al. | 222/105 |
| 5,697,524 | A | * | 12/1997 | Sedlmeier | 222/82 |
| 5,873,492 | A | | 2/1999 | Sullivan | |
| 5,897,028 | A | * | 4/1999 | Sauer | 222/82 |
| 6,048,201 | A | * | 4/2000 | Zwingenberger | 433/90 |
| 6,129,244 | A | * | 10/2000 | Horth | 222/94 |
| 6,206,244 | B1 | * | 3/2001 | Muhlbauer | 222/105 |
| 6,578,738 | B1 | * | 6/2003 | Keller | 222/83 |
| 6,766,921 | B2 | * | 7/2004 | Keller | 222/95 |
| 6,769,574 | B1 | * | 8/2004 | Keller | 222/137 |
| 7,510,546 | B2 | * | 3/2009 | Baessler et al. | 604/408 |
| 7,775,399 | B2 | * | 8/2010 | Wood | 222/94 |
| 2002/0162859 | A1 | | 11/2002 | Summons et al. | |
| 2005/0085786 | A1 | | 4/2005 | Baessler et al. | |
| 2005/0139616 | A1 | | 6/2005 | Ichikawa et al. | |
| 2006/0144854 | A1 | * | 7/2006 | Clemens et al. | 222/94 |

FOREIGN PATENT DOCUMENTS

| | | | | | |
|---|---|---|---|---|---|
| DE | 297 07 761 | U1 | | 8/1998 | |
| EP | 0 151 922 | A2 | | 8/1985 | |
| FR | 2568857 | | * | 8/1985 | 222/94 |
| WO | WO-86/04041 | | * | 7/1986 | 222/94 |
| WO | 2004076078 | A1 | | 9/2004 | |

* cited by examiner

*Primary Examiner* — Lien Ngo
(74) *Attorney, Agent, or Firm* — Hultquist, PLLC; Frank J. Bozzo; David S. Bradin

(57) ABSTRACT

A cartridge (120) secured to either a nozzle (110) and/or adaptor unit wherein the nozzle or adaptor unit comprises a substantially annular portion (135) adapted to fit snugly around an end of the cartridge (120) wherein the substantially annular portion (135) acts as a seal against any leakage from the cartridge (120).

19 Claims, 10 Drawing Sheets

NOZZLE AND/OR ADAPTOR UNIT ON CARTRIDGE

CROSS-REFERENCE TO RELATED APPLICATIONS

This application claims priority under the provisions of 35 USC §371 of International Application No. PCT/GB07/00439 filed Feb. 7, 2007, which in turn claims priority of United Kingdom Patent Application No. 0602340.2 filed Feb. 7, 2006. The disclosures of such international application and United Kingdom priority application are hereby incorporated herein by reference in their respective entireties, for all purposes.

FIELD OF THE INVENTION

The present invention relates to a cartridge unit suitable for storing and dispensing of products. In particular, the present invention relates to a cartridge containing an integral nozzle and/or adaptor unit.

BACKGROUND OF THE INVENTION

Dispensing apparatus in the form of cartridges is well-known in the art. In many instances, it is necessary to mix at least two different compounds together. On mixing, the compounds may react and usually harden. This type of technology is commonly used in chemical anchors, adhesives, sealants, food processing and medical applications. WO 2004/076078, which is incorporated herein by reference, relates to the use of apparatus comprising cartridges with a single rupturable sealing means. The single rupturable sealing means is formed from a weakened area in the cartridge. The cartridge partially expands into an expansion chamber and eventually bursts due to hydrostatic pressure.

However, it is found that cartridges during storage may sometimes have some form of leakage. A user therefore removing the cartridge from any form of packaging or inserting the cartridge into a dispensing gun may contaminate their fingers with the leaked contents of the cartridge. The contents of the cartridge may also contaminate clothing of a user.

It is an object of at least one aspect of the present invention to obviate or mitigate at least one or more of the aforementioned problems.

It is a further object of at least one aspect of the present invention to provide a cartridge which helps to contain any form of leakage and prevent the leakage contaminating a user's fingers and/or clothing.

SUMMARY OF THE INVENTION

According to a first aspect of the present invention there is provided:

a cartridge;

wherein said cartridge is substantially secured to either a nozzle and/or adaptor unit.

The cartridge may be 'sausage-like' in shape and may be formed in any suitable extrusion apparatus such as an adapted edible sausage making apparatus.

The cartridge may be made from thin, flexible film with a high tear strength. The cartridge may be made from any suitable plastics materials such as polyethylene. Alternatively, the cartridge may be made from a metal/alloy foil.

Typically, on a front portion of the cartridge, there may be substantially secured either a nozzle and/or adaptor unit. The nozzle or adaptor unit may have a substantially annular portion adapted to fit snugly around an end of the cartridge.

The nozzle or adaptor unit may therefore be adapted to fit around an end of the cartridge. On an inside surface of the annular portion in either the nozzle or adaptor unit, adhesive means such as any suitable type of glue may be used to securely adhere the nozzle or adaptor unit to the end of the cartridge. Alternatively, any suitable form of heat sealing means may be used to attach the nozzle or adaptor unit to the end of the cartridge. In alternative embodiments, any form of mechanical attachment means may be used.

The annular portion of the nozzle or adaptor unit may have a length of about 1 to 50 mm or preferably about 10 to 20 mm. The length of the annular portion which is attached on to the cartridge may be about 1 to 10 mm and preferably about 5 mm. The length of the annular portion may be adapted to provide a suitable surface for attaching to the end of the cartridge. The length of the annular portion may also be adapted so as not to prevent efficient utilisation and dispensing of the cartridge.

By securely attaching the nozzle or adaptor unit to the cartridge may have the function of containing any leakage from the cartridge. The leakage may come from sealing means on the cartridge.

In the embodiment when the adaptor unit is securely attached to the cartridge, a nozzle may be screwed onto the adaptor unit. To provide further securing of the nozzle to the dispensing apparatus, a restraining clip may be used to securely attach the nozzle to the main body of the dispensing apparatus.

Typically, the material forming the cartridge is not too elastic. If the material is too elastic, the apparatus will not function properly.

The material forming the cartridge may also be chosen so that it does not react and/or deteriorate on contact with the contained compounds.

Typically, the cartridge may comprise a plurality of separate chambers and, in particular, at least two chambers. The chambers may extend longitudinally from one of the cartridge to the other end of the cartridge. Different chambers may therefore form longitudinal segments along the length of the cartridge. The different chambers may contain different compounds which are intended to be mixed. The chambers may be of different volumes and may therefore contain different amounts of the different compounds.

Conveniently, on initial formation, the cartridge may have two open ends. Once the compound or compounds are extruded into the chamber or separate chambers of the cartridge, the ends of the cartridge may be sealed with any suitable sealing means. The seal for the end of the cartridge which is intended to rupture may be made weaker than a seal at the other end of the cartridge. The sealing means may comprise a sealing clip which may be releasable under pressure. Alternatively, any other suitable sealing means such as crimping, gluing, heat sealing or any other form of cap or tie may also be used.

Preferably, on release of the sealing means different contents of the cartridge may mix substantially simultaneously together. This occurs as the single sealing means, seals all of the contents of the cartridge. The mixing may occur immediately meaning that an efficient mix may be obtained.

Preferably, the cartridge is used in combination with a substantially rigid outer casing that may be a hollow cylindrical member made from any suitable plastics, metal or alloy material. The outer casing may have an inner cylindrical section which may be of constant diameter from one end to the other. Alternatively, the cylindrical member at one end may have a reduced diameter.

Typically, the outer casing may be adapted to receive the cartridge and form a snug fit with the outer walls of the cartridge. The snug fit may help to prevent radial expansion (i.e. widening) on application of pressure to an end of the cartridge.

Conveniently, pressure may be applied to one of the flexible cartridge by any suitable means such as any type of dispensing gun. The pressure may be applied manually or via a pneumatic piston. Typically, the dispensing gun may be of a standard mastic gun as found in many DIY stores. Alternatively, any type of syringe-like plunger or screw-like plunger may be used.

Conveniently, the dispensing apparatus may comprise an expansion chamber into which the cartridge may partially expand into on application of pressure to an end of the cartridge. The expansion chamber may be substantially funnel-like in shape and contains no sharp edges which may cut the film forming the cartridge. The apparatus may be adapted so that on application of pressure to one end of the cartridge, expansion in the axial direction is prevented so that at the opposite end to which the pressure is applied, the cartridge deforms into an initial bulbous confirmation and may partially fill the expansion chamber.

Preferably, the outer casing comprises integral reaction shoulders with abut and prevent the cartridge from moving further along the longitudinal length of the outer casing as pressure is applied. The reaction shoulders may be adapted to the shape of the cartridge and may be substantially concave. The actual surface contact area between the reaction shoulder and the cartridge may be specifically chosen. If there is too much contact between the reaction shoulder and the cartridge, too much pressure will need to be applied to remove the sealing means from the cartridge and the material forming the cartridge may rupture at any specific point meaning that different compounds in the different chambers may not mix. Alternatively, if there is too little surface contact between the reaction shoulders and the cartridge, the cartridge will be pushed through the outer casing without the sealing means rupturing.

In an alternative embodiment, the reaction shoulder may be formed with a separate insert which may be inserted into the outer casing. In a yet further alternative, the cartridge may be glued to the side of the outer casing thereby preventing movement along the length of the outer casing.

Typically, the expansion chamber may be integrally formed in the outer casing during initial moulding. Alternatively, the expansion chamber may be formed by a separate adaptor unit which may be placed into the outer casing. In a further alternative, the expansion chamber may be contained within a separate nozzle member.

Conveniently, the dispensing apparatus comprises a nozzle member which may be fitted to an end of the outer casing via, for example, a screw thread. The nozzle may comprise an integral mixer unit which further aids the mixing of the different products in the flexible cartridge. Alternatively, the mixer unit may be a separate item and may be inserted into the nozzle. Preferably, the diameter of the nozzle is wide enough to prevent blockage on release of the sealing means.

The nozzle may also comprise means for catching the sealing means such as a cross-member. The cross-member may be attached to the mixer unit or may be integrally formed at the entrance to the nozzle.

Preferably, the sealing means may be formed from any metal or plastics material such as soft aluminium or steel wire which is wound round the ends of the cartridge. The sealing means is not attached too tightly or too strongly as this will prevent the release of the sealing means on application of pressure to the cartridge. It is also preferred that any sharp ends formed by the sealing means may be pointed away from the flexible cartridge thereby preventing any possible piercing of the cartridge.

Preferably, the film forming the cartridge may be adapted so that on expansion into the expansion chamber, the film extends part way into the expansion chamber. This may prevent mixing of different compounds and may therefore prevent any hardening of mixed materials within the apparatus. This may allow the apparatus to be used at a later date without completely emptying the contents of the cartridge. Typically, the apparatus may be used to provide dispensed products for use in chemical anchors, sealants, food processing and medical applications. Uses of chemical anchors includes securing bolts in concrete/masonry, forming a stud socket and post-installed rebar connections.

Compounds which are intended to be mixed may include any suitable resins, epoxies, polyesters and vinyl esters.

According to a second aspect of the present invention there is provided a dispensing apparatus comprising:

a cartridge according to the first aspect;

a substantially rigid outer casing which is adapted to receive the cartridge; and a dispensing gun.

BRIEF DESCRIPTION OF THE DRAWINGS

Embodiments of the present invention will now be described, by way of example only, with reference to the accompanying drawings in which.

DETAILED DESCRIPTION

Figure 1:
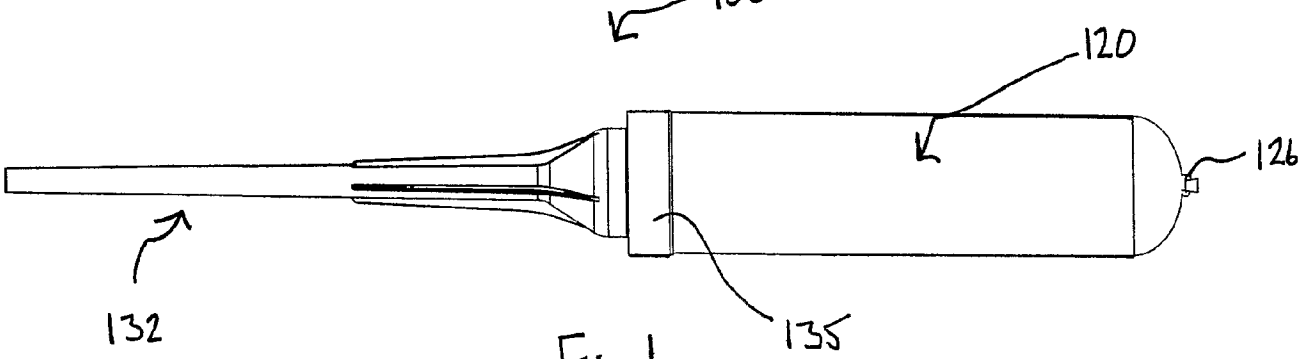
FIG. 1 is a side view of dispensing apparatus according to a first embodiment of the present invention.

Referring to FIG. 1, there is dispensing apparatus, generally designated 100. The dispensing apparatus 100 comprises a cartridge 120 which is attached to a nozzle 132. Part of an annular portion 135 of the nozzle 132 is securely attached to the cartridge 120.

Figure 2:
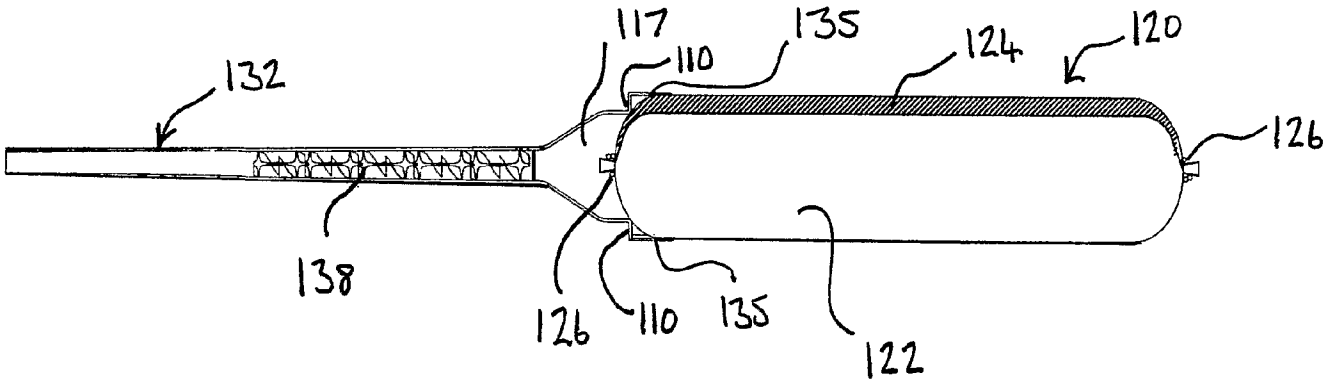
FIG. 2 is a sectional view of the dispensing apparatus shown in FIG. 1.

FIG. 2 is a sectional view of the dispensing apparatus 100. As shown in FIG. 2, the nozzle 132 is attached using part of the annular portion 135 which extends around an end of the cartridge 120. The nozzle 132 is attached to the cartridge 120 by applying adhesive to the inner surface of the annular portion 135 and is then slid onto the cartridge 120. About 5 mm of the annular portion 135 is secured to the cartridge 120. By attaching the nozzle 132 in this manner, helps to contain any leakage seeping from sealing means 126 on the cartridge 120.

The cartridge 120 is a two-component cartridge containing a first component 122 and a second component 124. As shown in FIG. 2, the cartridge is abutting against shoulders 110 in the inner surface of the nozzle 132.

FIG. 2 also shows that there is an expansion chamber 117 into which the cartridge 120 may partially expand in to on application of pressure to one end of the cartridge 120. The cartridge 120 expands into a substantially bulbous form without touching the sides of the expansion chamber 117. When the hydrostatic pressure reaches a certain point, the sealing means 126 on the cartridge 120 bursts thereby enabling the contents of the cartridge 120 to be dispensed and substantially simultaneously mixed. To enhance the mixing effect, a mixer element 138 is provided in the nozzle 132.

Figure 3:
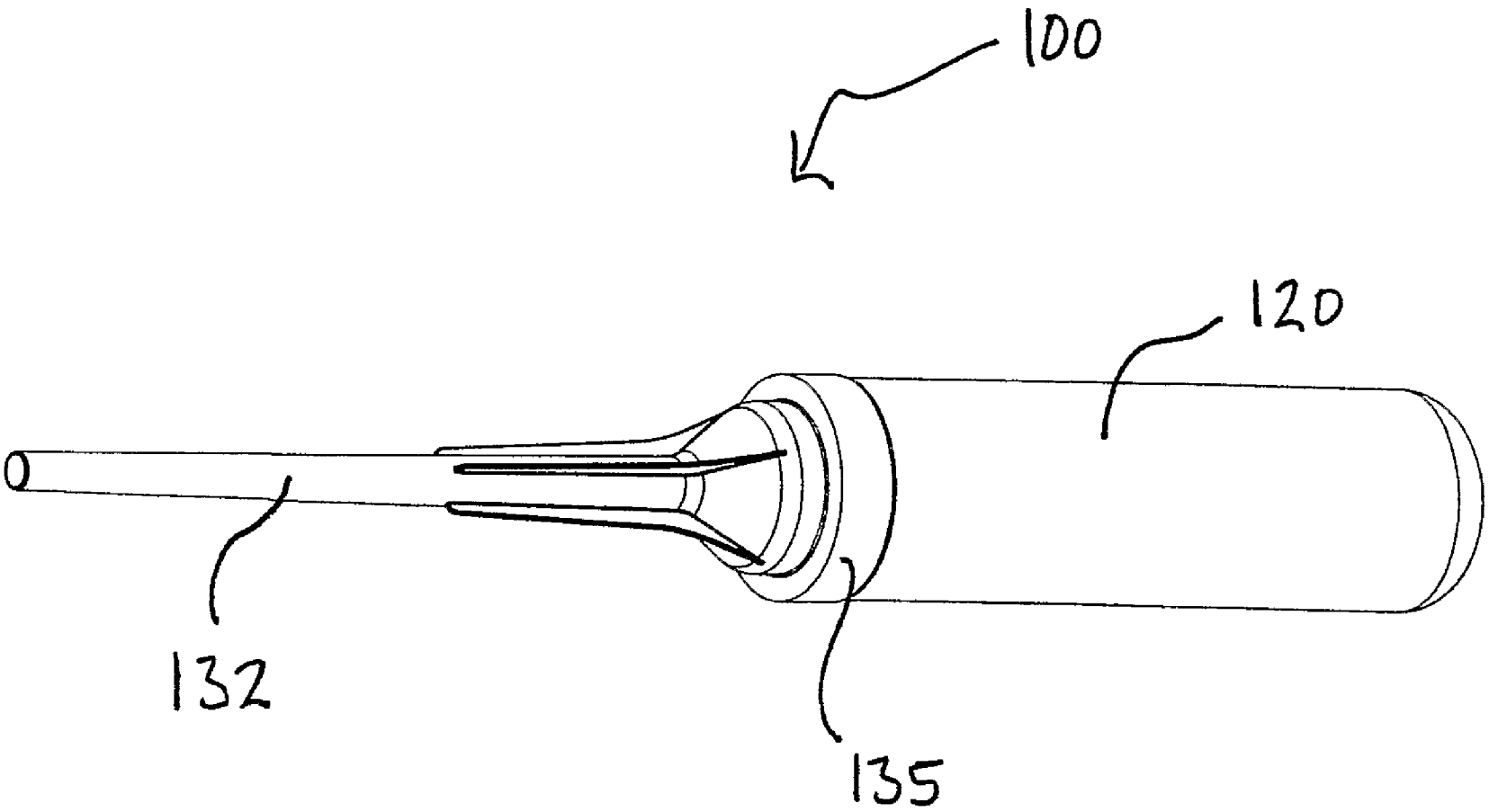
FIG. 3 is a further view of the apparatus shown in FIGS. 1 and 2.

FIG. 3 is a perspective view of the dispensing apparatus 100 providing a further view of the annular portion 135.

Figure 4A:
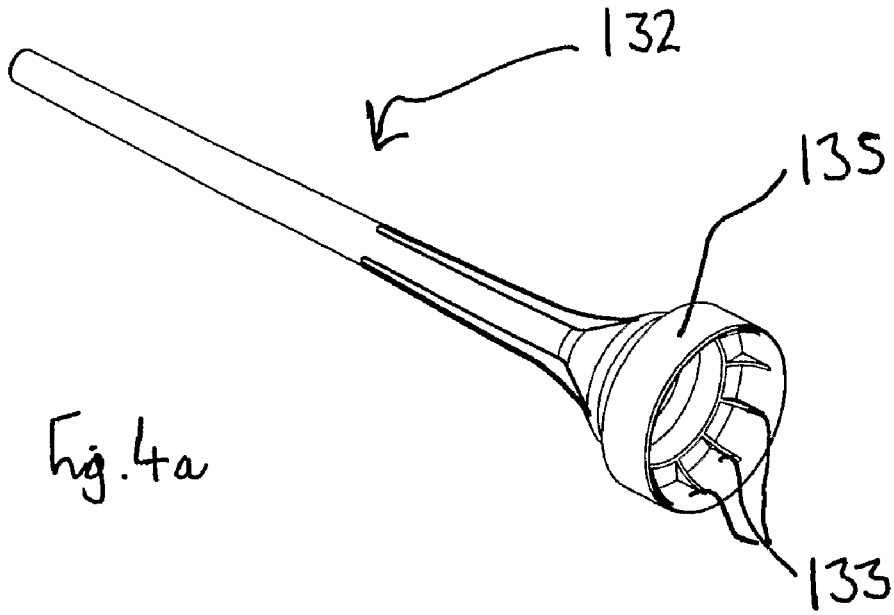
FIGS. 4*a* and 4*b* are views of the nozzle shown in the apparatus of FIGS. 1 to 3.
Figure 4B:
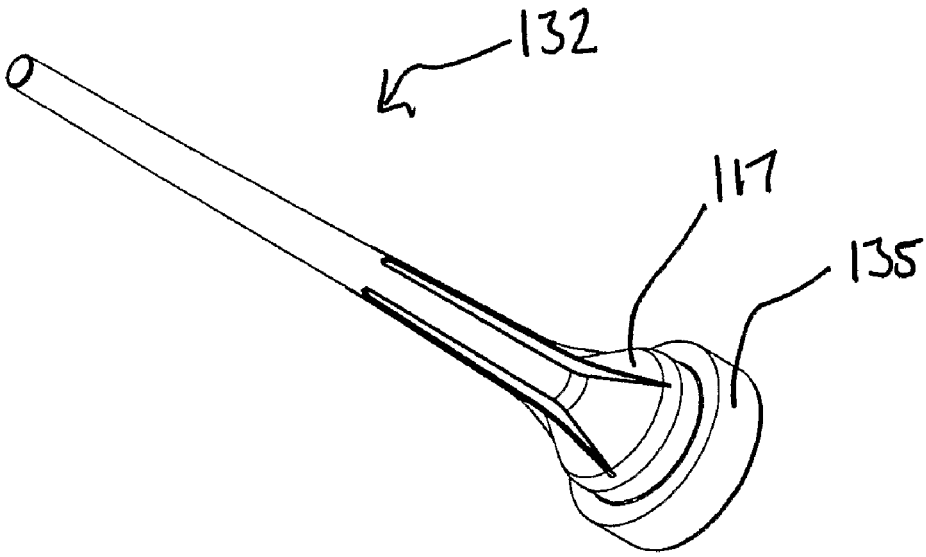

FIGS. 4 and 4*b* provide further views of the nozzle 132. The nozzle 132 comprises at one end the annular portion 135 which is adapted to fit over an end of the cartridge 120. The inner surface of the annular portion 135 contains strengthening ribs 133 which are not intended to engage and interact with the cartridge 120. The strengthening ribs 133 help to maintain the configuration of the end of the annular portion 135 and may therefore help to prevent the formation of sink marks on the cartridge 120. The strengthening ribs 133 are also relatively easy to manufacture.

The length of the annular area beyond the limit of the strengthening members 133 provides a substantially annular surface of application which is intended to be attached to the cartridge 120. Usually, the length beyond the strengthening members 133 is about 5 mm. Adhesive means may be applied around this part of the inner area of the annular portion 135.

Figure 5:
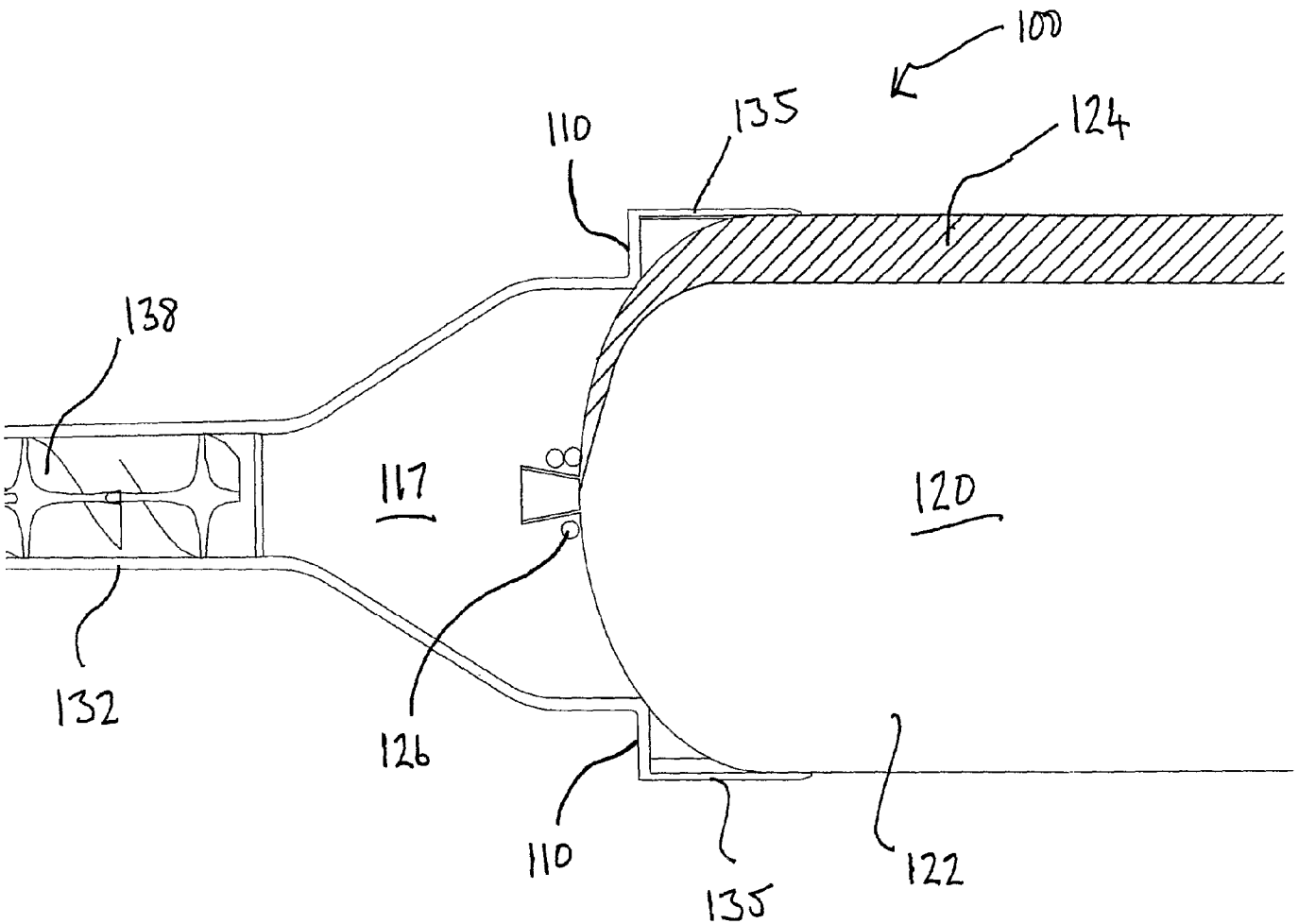
FIG. 5 is an expanded sectional view of the apparatus shown in FIGS. 1 to 3.

FIG. 5 is an expanded view of the dispensing apparatus 100. The annular portion 135 of the nozzle 132 is shown as being securely attached to the cartridge 120.

Figure 6:
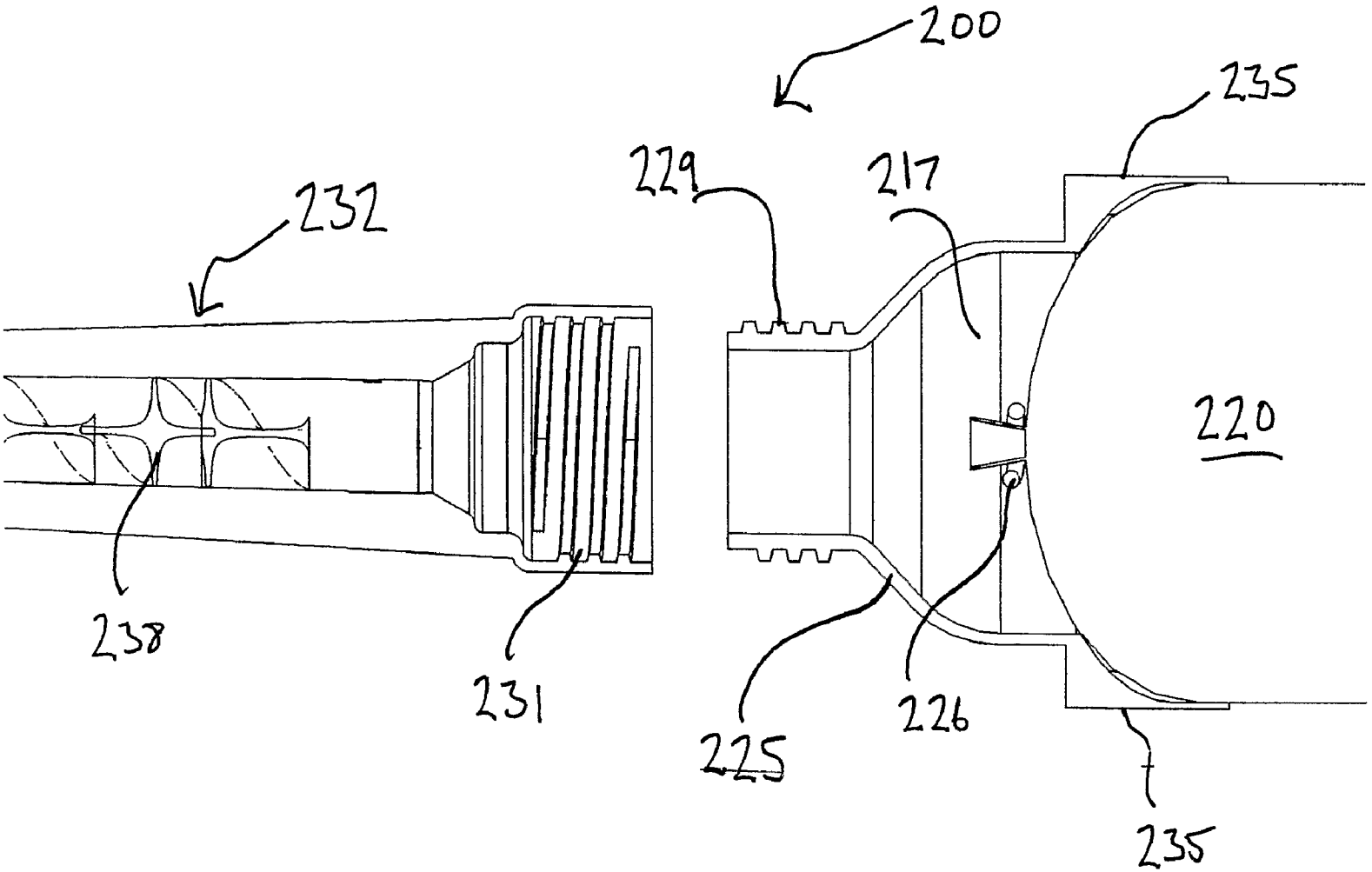
FIG. 6 is a sectional view of dispensing apparatus according to a second embodiment of the present invention.

FIG. 6 relates to a further embodiment of the invention and shows dispensing apparatus, generally designated 200. In the dispensing apparatus 200, an adaptor unit generally designated 225 is securely attached to the cartridge 220. Part of the annular portion 235 of the adaptor unit 225 is securely attached to the cartridge 220 using adhesive means such as glue. About a 5 mm length of the annular portion 235 is secured to the surface of the cartridge 220.

The adaptor unit 225 comprises an expansion chamber 217 into which the cartridge 220 may partially expand into prior to the sealing means 226 bursting and enabling the contents of the cartridge 220 to substantially simultaneously mix.

The adaptor unit 225 also comprises a thread 229 which may be attached to a thread 231 on the nozzle 232. To aid mixing, the nozzle 232 comprises an integral mixer unit 238.

Figure 7:
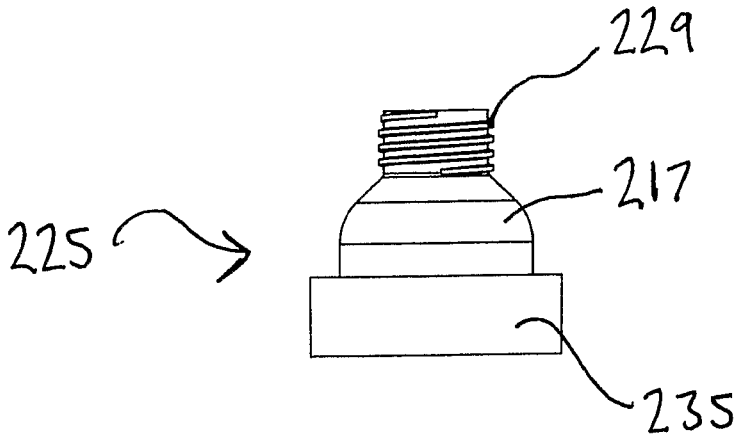
FIGS. 7 to 9 are views of the adaptor unit as shown in FIG. 6.
Figure 8:
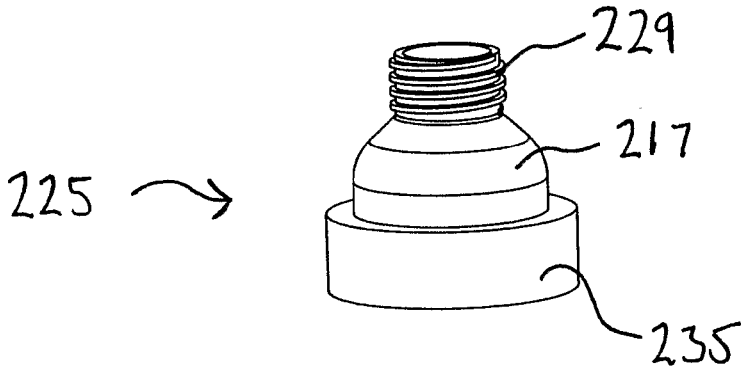
Figure 9:
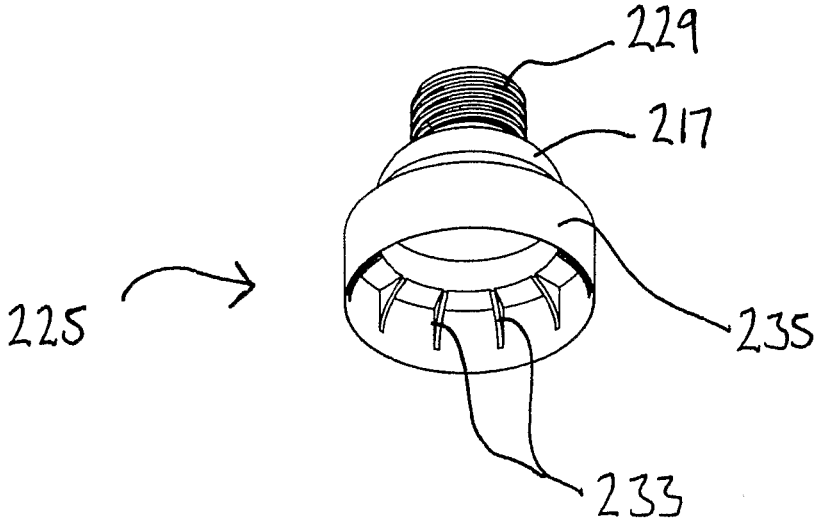

FIGS. 7-9 represent the adaptor unit 225. The adaptor unit 225 comprises an annular portion 235 part of which may be securely attached to the cartridge 220. As shown in FIGS. 7 to 9, the adaptor unit 225 comprises an expansion chamber 217 and a thread 229. Any suitable form of nozzle may be attached onto the thread 229 of the adaptor unit 225.

Figure 10:
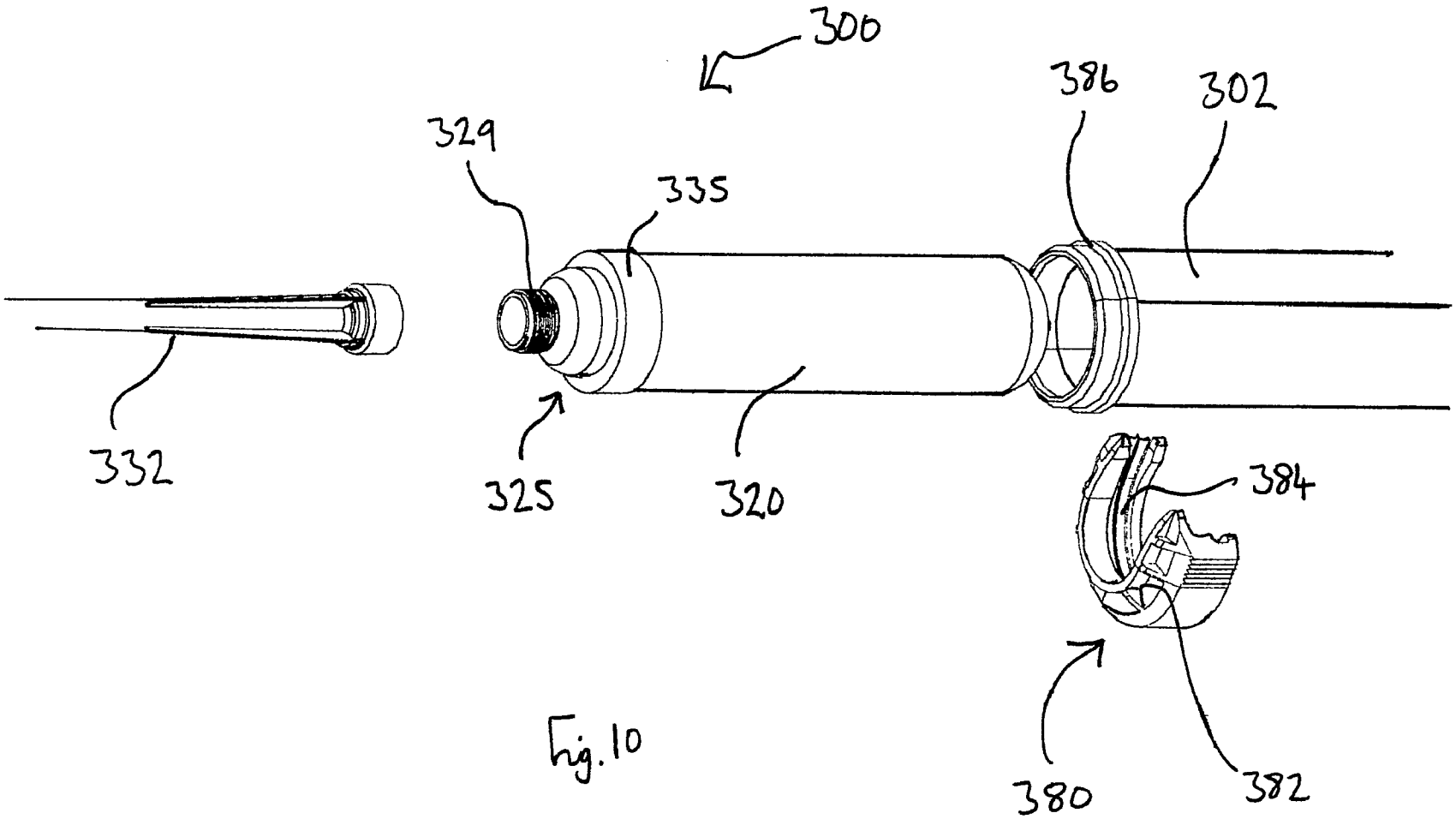
FIG. 10 is a representation of the dispensing apparatus shown in FIG. 6 ready to be inserted into a casing.

FIG. 10 shows a further embodiment of the invention relating to dispensing apparatus, generally designated 300. As shown in FIG. 300, there is a cartridge 320 which is attached onto an adaptor unit 325. An inside portion of the annular portion 335 of the adaptor unit is attached using adhesive means to the cartridge 320. About a 5 mm length of the annular portion 335 is attached to the cartridge 320. The adaptor unit comprises a thread 320 which may be attached onto a corresponding thread on the nozzle 332.

The cartridge 320 is ready to be inserted into a substantially rigid casing 302. There is also shown a restraining clip 380. The restraining clip 380 comprises an upper portion 382 and attachment means 384 which may be securely attached to a receiving member 386 on the top of the casing 302.

Figure 11:
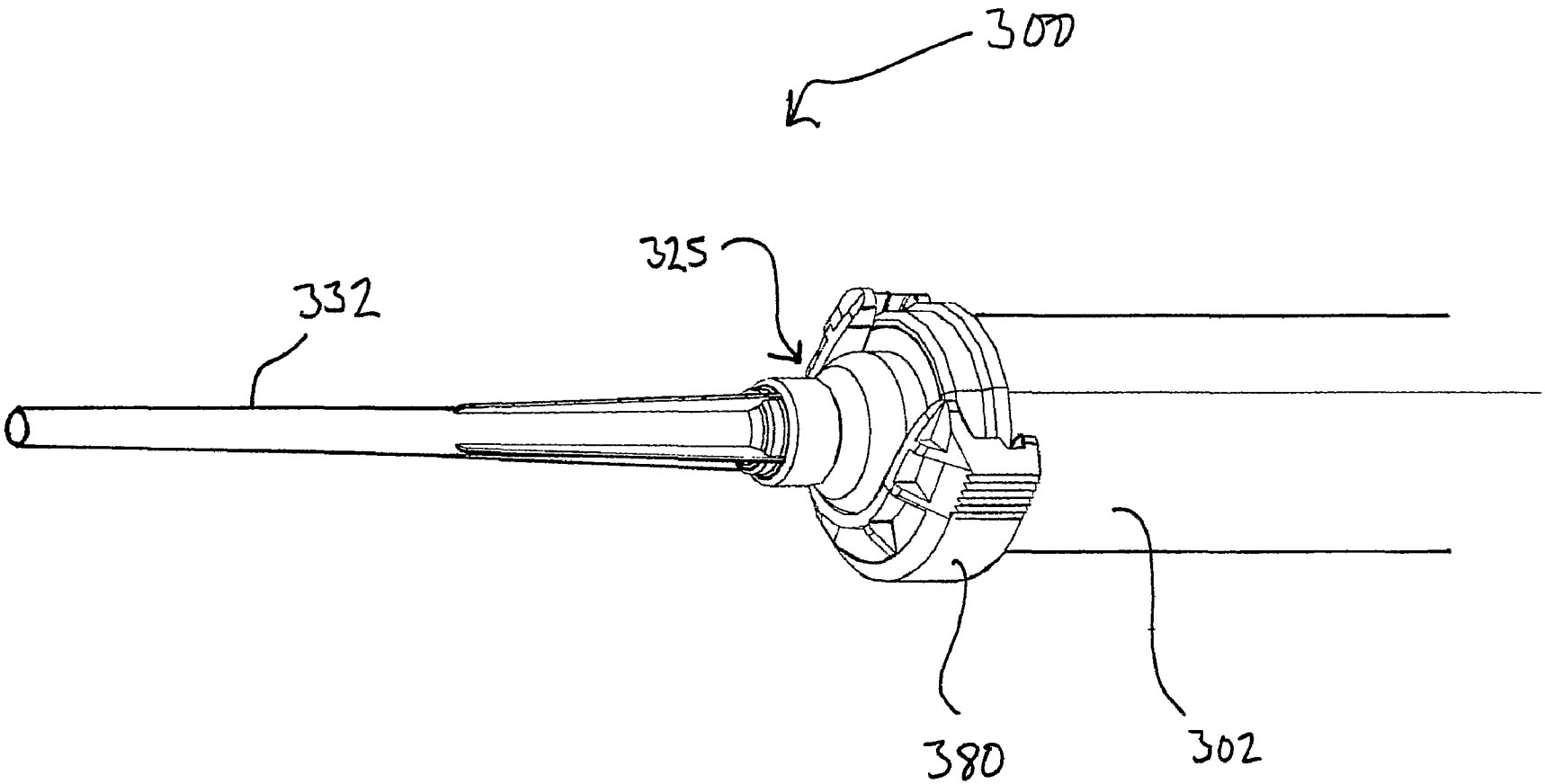
FIG. 11 shows the apparatus shown in FIG. 10 ready for use.

FIG. 11 shows the restraining member 382 attached to the casing 302. The apparatus 300 is therefore ready for use.

Figure 12:
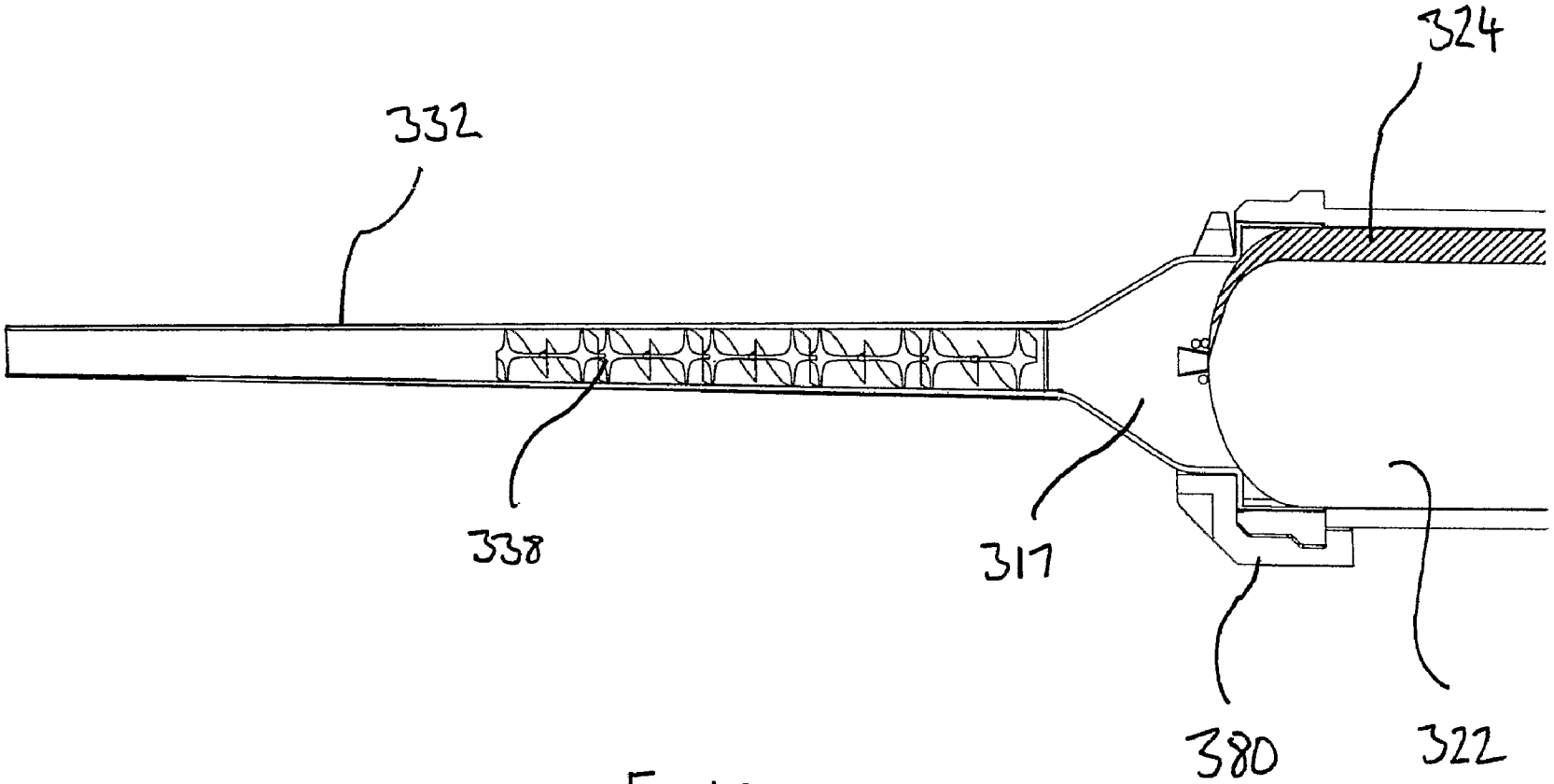
FIG. 12 is a sectional view of the dispensing apparatus shown in FIG. 11.
Figure 13:
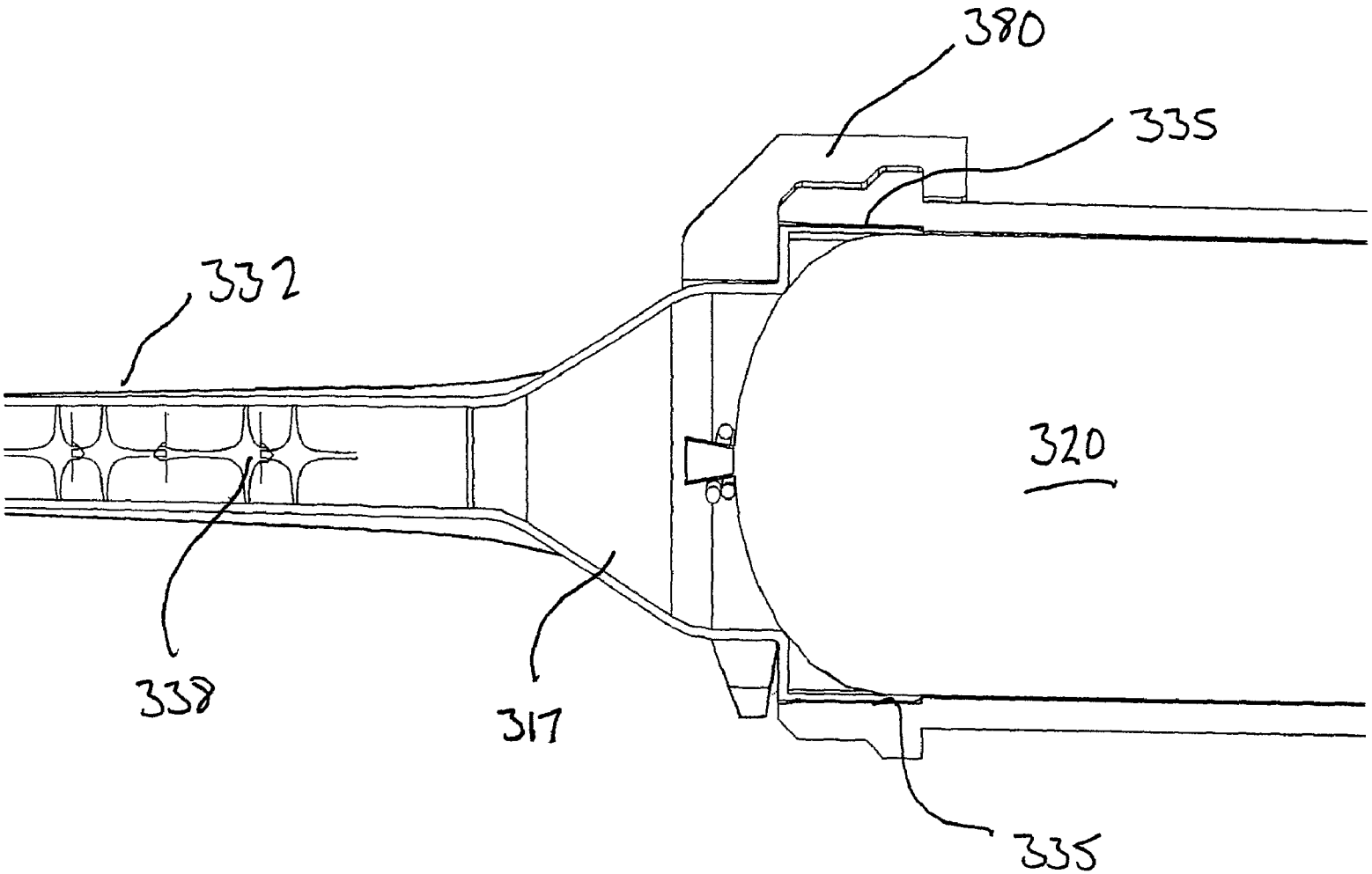
FIG. 13 is an expanded sectional view of the apparatus shown in FIG. 12.

FIGS. 12 and 13 are sectional views of the apparatus 300. As shown in FIGS. 12 and 13, part of the annular portion 335 of the adaptor unit 325 is attached to the casing 320. The restraining clip 380 helps to retain the nozzle 332 on the casing 320 as the contents of the cartridge 320 are being dispensed.

Whilst specific embodiments of the invention have been described above, it will be appreciated that departures from the described embodiments may still fall within the scope of invention. For example, there may be any form of adaptor unit or nozzle unit secured and engaged onto a cartridge. Any suitable type of mechanical or chemical attachment means such as gluing or heat sealing may be used. The cartridge may also comprise any number of different chambers and may be of any suitable size. Furthermore, by securely engaging the cartridge onto an adaptor unit or nozzle member may help to partially pressurise the chamber and therefore prevent any under filling of the sausage which may compromise the effectiveness of the bursting chamber.

The invention claimed is:

1. A dispensing apparatus for use with a dispensing gun, comprising:

a cartridge configured to receive a component to be dispensed and to dispense the component under pressure applied by a dispensing gun;

a nozzle or adaptor unit securely attached to the cartridge, wherein the nozzle or adaptor unit includes a substantially annular portion adapted to fit snugly around a first end of the cartridge, and wherein the substantially annular portion acts as a seal against any leakage of the component from the cartridge;

a substantially rigid casing configured to insertably receive the cartridge, wherein the substantially rigid casing includes a receiving member at a first end of the substantially rigid casing, and wherein the nozzle or adaptor unit at least partially extends from the first end of the substantially rigid casing; and a restraining clip configured to engage both at least a portion of the nozzle or adaptor unit at least partially extending from the first end of the substantially rigid casing and the receiving member of the substantially rigid casing to assist in maintaining attachment of the nozzle or adaptor unit to the cartridge as the component is dispensed.

2. A dispensing apparatus according to claim 1, wherein an inside surface of the substantially annular portion of the nozzle or adaptor unit comprises an adhesive element to secure the nozzle or adaptor unit to the first end of the cartridge.

3. A dispensing apparatus according to claim 2, wherein the substantially annular portion of the nozzle or adaptor unit has a width of about 1 to 50 mm.

4. A dispensing apparatus according to claim 1, wherein the substantially annular portion has a substantially smooth surface which has the function of containing any leakage from the cartridge by forming a continuous seal around the cartridge.

5. A dispensing apparatus according to claim 1, wherein the cartridge comprises a plurality of separate chambers, with each chamber of the plurality of separate chambers containing a different material, wherein said different materials efficiently mix upon bursting of the cartridge.

6. A dispensing apparatus according to claim 1, wherein ends of the cartridge are sealed with at least one sealing clip that is releasable under pressure.

7. A dispensing apparatus according to claim 1, adapted to promote substantially simultaneous mixing together of different components contained within the cartridge upon release of a sealing element.

8. A dispensing apparatus according to claim 1, wherein the cartridge fits snugly within the substantially rigid casing.

9. A dispensing apparatus according to claim 8, further comprising an expansion chamber into which the cartridge partially expands on application of pressure to an end of the cartridge.

10. A dispensing apparatus according to claim 8, wherein the substantially rigid casing includes integral reaction shoulders that abut and that prevent the cartridge from moving further along a longitudinal length of the outer casing as pressure is applied.

11. A dispensing apparatus according to claim 8, wherein the nozzle or adaptor unit includes one of:

a single unit including an adaptor portion securely attached to the cartridge and a nozzle portion extending from the adaptor portion; and a separate adaptor member secure attached to the cartridge and supporting a first screw thread configured to engage a second screw thread of a separately attachable nozzle member.

12. An apparatus for use with a dispensing gun, comprising:

a cartridge configured to receive a component to be dispensed and to dispense the component under pressure applied by a dispensing gun;

an adaptor unit securely attached to the cartridge, wherein the adaptor unit includes a substantially annular portion configured to seal against leakage from the cartridge and a chamber configured to receive the component from the cartridge;

a substantially rigid casing configured to insertably receive the cartridge, wherein the substantially rigid casing includes a receiving member at a first end of the substantially rigid casing, and wherein the adaptor unit at least partially extends from the first end of the substantially rigid casing; and a restraining clip configured to engage both at least a portion of the adaptor unit at least partially extending from the first end of the substantially rigid casing and the receiving member of the substantially rigid casing to support the adaptor unit in maintaining attachment of the adaptor unit to the cartridge as the component is dispensed.

13. The apparatus of claim 12, wherein the substantially annular portion of the adaptor unit is adapted to fit snugly around an end of the cartridge.

14. The apparatus of claim 13, wherein the substantially annular portion of the adaptor unit comprises an adhesive element to secure the adaptor unit to the end of the cartridge.

15. The apparatus of claim 12, wherein the adaptor unit supports a first screw thread configured to engage a second screw thread of a separately attachable nozzle.

16. An apparatus for use with a dispensing gun, comprising:

a cartridge configured to receive a component to be dispensed and to dispense the component under pressure applied by a dispensing gun;

a nozzle securely attached to the cartridge, wherein at a first nozzle end the nozzle includes a substantially annular portion configured to seal against leakage from the cartridge, and wherein at a second nozzle end the nozzle is configured to dispense the component;

a substantially rigid casing configured to insertably receive the cartridge, wherein the substantially rigid casing includes a receiving member at a first end of the substantially rigid casing, and wherein the nozzle at least partially extends from the first end of the substantially rigid casing; and a restraining clip configured to engage both at least a portion of the nozzle at least partially extending from the first end of the substantially rigid casing and the receiving member of the substantially rigid casing to support the nozzle in maintaining attachment of the nozzle to the cartridge as the component is dispensed.

17. The apparatus of claim 16, wherein the substantially annular portion of the nozzle is adapted to fit snugly around an end of the cartridge.

18. The apparatus of claim 17, wherein the substantially annular portion of the nozzle comprises an adhesive element to secure first end of the nozzle to the end of the cartridge.

19. The apparatus of claim 16, wherein the first end of the nozzle further comprises a chamber configured to receive the component from the cartridge.

* * * * *